United States Patent [19]

Lash

[11] Patent Number: 4,543,166

[45] Date of Patent: Sep. 24, 1985

[54] ZINC-ALLOY ELECTROLYTE AND PROCESS

[75] Inventor: Ronald J. Lash, Rochester, Mich.

[73] Assignee: OMI International Corporation, Warren, Mich.

[21] Appl. No.: 655,838

[22] Filed: Oct. 1, 1984

[51] Int. Cl.[4] ..... C25D 3/56

[52] U.S. Cl. ..... 204/44.2

[58] Field of Search ..... 204/44.2, 44.5, 123, 204/55 R

[56] References Cited

U.S. PATENT DOCUMENTS

| | | | |
|---|---|---|---|
| 3,909,373 | 9/1975 | Creutz | 204/55 R |
| 4,170,526 | 10/1979 | Creutz et al. | 204/55 R |
| 4,207,150 | 6/1980 | Creutz et al. | 204/55 R |
| 4,252,619 | 2/1981 | DaFonte et al. | 204/55 R |
| 4,425,198 | 1/1984 | Martin | 204/43 Z |

*Primary Examiner*—G. L. Kaplan

*Attorney, Agent, or Firm*—Richard P. Mueller

[57] ABSTRACT

An aqueous acidic electrolyte and process for electrodepositing zinc alloys comprising zinc-nickel, zinc-cobalt and zinc-nickel-cobalt on a conductive substrate incorporating a brightener system including a ductilizing agent present in an amount sufficient to reduce stress and fracturing of the zinc alloy electrodeposit providing for improved corrosion resistance of the deposit. The ductilizing agents are sulfonates of an aldehyde or ketone.

20 Claims, No Drawings

ZINC-ALLOY ELECTROLYTE AND PROCESS

BACKGROUND OF THE INVENTION

The present invention relates to zinc-alloy electroplating solutions and more specifically to an electrolyte and process for the electrodeposition of zinc-alloy deposits, such as zinc-cobalt, zinc-nickel or zinc-cobalt-nickel deposits having improved corrosion resistance. In particular, the present invention relates to an improved brightener system for zinc-alloy electroplating solutions.

A variety of zinc-alloy electroplating baths and brightener systems for use therein have heretofore been used or proposed for use. However, although such prior art brightener systems are capable of providing a bright zinc-alloy electrodeposit, there remains a need for economical zinc-alloy electroplating baths for depositing bright zinc-alloy coatings with improved morphological properties and, in particular, for zinc-alloy plating baths capable of providing electrodeposits having improved corrosion resistance. Thus, there is continued research into additives, processing parameters and the like for the purpose of improving corrosion resistance.

It has been found that a brightener system for a zinc-alloy electroplating solution which includes a ductilizer component as disclosed herein provides a zinc-alloy electroplate having improved corrosion resistance in actual use. The ductilizer is believed to reduce fracturing of the electrodeposit and to provide an electrodeposit having lower stress. The electroplating solution of this invention provides a bright, lustrous zinc-alloy electrodeposit having a smooth, grain-refined structure and improved corrosion resistance.

Further understanding of the present invention will be had from the following disclosure and claims. All parts and percentages herein are by weight unless otherwise indicated.

SUMMARY OF THE INVENTION

In accordance with the present invention, a sulfonate of an aldehyde or ketone is employed as a ductilizer in a brightener system for a zinc-alloy electroplating bath. A bath of the present invention thus comprises: a primary brightener, a carrier, an auxiliary brightener, and a ductilizer selected from the group consisting of a sulfonate of an aldehyde and a sulfonate of a ketone. In accordance with the method of the present invention, a process for depositing a zinc-alloy electroplate on a substrate comprises the step of electrodepositing a zinc-alloy from an aqueous zinc-alloy electroplating bath of the present invention.

DETAILED DESCRIPTION OF THE INVENTION

The improved electrolyte of the present invention comprises an aqueous zinc-alloy electroplating solution comprising zinc, cobalt and/or nickel ions and effective amounts of a primary brightener, a carrier, an auxiliary brightener, and a ductilizer. The ions in the bath comprise zinc ions in combination with at least one additional metal ion selected from the group consisting of nickel ions, cobalt ions and mixtures thereof.

The zinc and alloying metal ions are introduced into the solution in a conventional manner, typically as soluble salt, preferably, as the respective chlorides. Thus, zinc is typically added as zinc chloride, nickel is typically added as nickel chloride hexahydrate, and cobalt as cobalt chloride hexahydrate. The zinc ions are employed in the bath in an amount of at least about 10 grams per liter (g/l) up to the maximum solubility of zinc in the bath. The alloying metal ions are employed in the bath in an amount of at least about 0.5 g/l up to about 60 g/l with an amount of about 5 to about 25 g/l being preferred. The alloy electrodeposit in accordance with the present invention can contain cobalt, nickel and mixtures thereof in an amount of about 0.01 percent to about 15 percent of the total amount of the alloy deposit. Preferably the amount of alloy metal in the electrodeposit is from about 0.1 to about 5 percent cobalt or about 0.25 to about 9 percent nickel. Where a mixture of nickel and cobalt is employed, any ratio of nickel to cobalt can be employed in the zinc alloy.

During operation of the electroplating process, the metal ions in the electrolyte are depleted and replenishment thereof is effected by the use of soluble anodes and/or bath soluble and compatible salts. The ratio of zinc ions and alloying metal ions is controlled to provide an electrodeposit of the desired alloy composition.

In addition to metal ions, the electroplating solution of the present invention further includes a brightener system comprising a primary brightener, a carrier, an auxiliary brightener, and a ductilizer. The primary brightener is an additive which functions to provide a bright, lustrous zinc-alloy deposit. Suitable primary brighteners include those selected from the group consisting of aryl ketones, alkyl aldehydes, alkyl ketones and mixtures thereof; heterocyclic aldehydes, heterocyclic ketones, alkyl nicotinate quaternaries and heterocyclic quaternaries with dialkyl sulfate or alkylaryl halides as described in U.S. Pat. No. 3,909,373 to Creutz, alkylalkane sulfonates, or alkylarene sulfonates and mixtures thereof. Suitable alkyl nicotinate sulfates or sulfonated quaternary salts are disclosed in U.S. Pat. No. 4,207,150, June 10, 1980, to Creutz, et al. Suitable alkylalkane sulfonates and alkylarene sulfonate quaternaries are disclosed in U.S. Pat. No. 4,170,526, which issued Oct. 9, 1979, to Creutz, et al. The primary brightener is employed in the bath in an amount effective to obtain the lustrous deposit desired. Generally speaking, this will be an amount of from about 0.001 to about 10 g/l, preferably from about 0.10 to about 5 g/l.

The carrier is an additive which functions to refine the grain and provide a smooth electrodeposit. Suitable carriers can be selected from the group consisting of alkoxylated polymers, block polymers, polyglycidols, alkoxylated acetylenics, alkoxylated phenols and alkoxylated naphthols. The carrier is employed in the solution in an amount effective to refine the grain of the electrodeposit, and generally from about 0.5 to about 10 g/l, with from about 2 to about 6 g/l being preferred.

The auxiliary brightener is an additive which is in the nature of a catalyst. By itself the auxiliary brightener has little or no effect on the electroplate but serves to enhance the above-mentioned effects of the primary brightener and carrier. The auxiliary brightener may be an aromatic acid such as benzoic acid, salicylic acid, nicotinic acid, cinnamic acid as well as the Group I and II metal and ammonium salts thereof. The amount of auxiliary brightener in the electrolyte of the present invention is controlled to impart the desired supplemental brightness to the electrodeposit and may range from about 0.6 to about 10 g/l with from about 1.2 to about 5 g/l being preferred.

In addition to the above components, the electrolyte of the present invention comprises a ductilizer which functions to provide a substantially microcrack-free and stress-free electrodeposit having improved corrosion resistance. The preferred ductilizer for use in the present invention is disclosed in U.S. Pat. No. 4,252,619, Feb. 24, 1981 to DaFonte, Jr., et al. In the DaFonte patent, certain sulfonates of an aldehyde or ketone are taught to be useful as brightening agents and ductilizers in zinc electroplating solutions. Suitable compounds are those represented by the following structural formula:

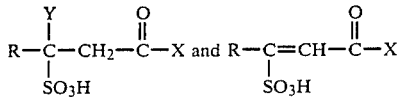

Wherein:

R is H or $C_6$–$C_{10}$ aryl, or $C_6$–$C_{20}$ alkyl aryl in which the alkyl group is $C_1$–$C_4$; or $C_1$–$C_{22}$ alkyl, or $C_2$–$C_{10}$ heterocyclic nitrogen compounds having at least one tertiary or quaternary ring containing nitrogen; as well as the mono, di or tri substituted derivatives thereof including —OH, —$SO_3H$ or —COOH; the Group I and II metal and $NH_4$ salts thereof; and the aldehyde, ketone and ether derivatives thereof;

X is R or —OR′ or —$NR_2$′ in which R′ is H or a $C_1$–$C_4$ aliphatic radical; and Y is H or $SO_3H$;

as well as the compatible water soluble salts thereof.

The ductilizing agent is employed in an amount effective to impart ductility to the zinc alloy electrodeposit and can be employed in a concentration of from about 0.001 up to about 10 g/l with concentrations of about 0.01 to about 5 g/l being preferred.

Typical of compounds which can be satisfactorily employed as ductilizers are set forth below:

3-sulfopropanal, sodium salt
4-phenyl-4-sulfobutan-2-one, sodium salt
4-phenyl-4-sulfobuten-2-one, sodium salt
4-phenyl-4,4-disulfobutan-2-one, disodium salt
4-sulfo-4-(3,4-dimethoxyphenyl)butan-2-one, sodium salt
4-(3,4-methylenedioxyphenyl)-4-sulfobutan-2-one, sodium salt
3-sulfo-3-phenylpropanal, sodium salt
3-sulfo-3-phenylpropanoic acid, monosodium salt
1,3-diphenyl-3-sulfopropan-1-one, sodium salt
3-sulfobutanal, sodium salt
3-(2-furyl)-3-sulfopropanal, sodium salt
3-(3-indolyl)-sulfopropanoic acid, monosodium salt
3-(5-bicyclo [2.2.1]heptene)-3-sulfopropanoic acid, monosodium salt
4-sulfobutan-2-one, sodium salt
3,3-diphenyl-3-sulfopropanal, sodium salt
3-phenyl-3-sulfopropenal, sodium salt
3-phenyl-3,3-disulfopropanal, disodium salt
1-(4-piperidyl)-3-sulfo-5-(3,4-methylenedioxyphenyl)-4-penten-1-one, sodium salt
1-(4-piperidyl)-5-sulfo-5-(3,4-methylenedioxyphenyl)-2-penten-1-one, sodium salt
1-(4-piperidyl)-3,5-disulfo-5-(3,4-methylenedioxyphenyl)-1-pentanone, disodium salt
3-(3-pyridyl)-3-sulfopropanoic acid, monosodium salt
3-(4-imidazyl)-3-sulfopropanoic acid, monosodium salt
4-phenyl-2-sulfo-4-oxobutanoic acid, monosodium salt
4-phenyl-3-sulfo-4-oxobutanoic acid, monosodium salt
1,7-di-(3-methoxy-4-hydroxylphenyl)-7-sulfo-1-hepten-3,5-dione, sodium salt
1,7-di-(3-methoxy-4-hydroxyphenyl)-1,7-disulfohepta-3,5-dione, disodium salt
4-(2-furyl)-4-sulfobutan-2-one, sodium salt
4-phenyl-4-sulfobuten-2-one, sodium salt
4-phenyl-4,4-disulfobutan-2-one, disodium salt
3-phenyl-3-sulfopropenal, sodium salt
3-phenyl-3,3-disulfopropanal, disodium salt
4-sulfobuten-2-one, sodium salt
4,4-disulfobutan-2-one, disodium salt Of the foregoing, 4-phenyl-4 sulfobutan-2-one, sodium salt and 3-sulfo-3-phenylpropanal, sodium salt have been found to be particularly satisfactory.

An electroplating solution of the present invention will have a pH at which the metal salts have sufficient solubility and at which the brightener system is effective. Thus, the lower limit of the pH is that at which the brightening system no longer obtains the desired brightening effect whereas the upper limit of pH is set by the pH at which insufficient metal ions remain in solution to obtain the desired zinc-alloy deposit. Generally, the pH can range from about 3 up to about 6.9, and preferably, the pH of a solution will range from about 4 to about 6.

The electrolyte of the present invention can also contain conventional amounts of additional ingredients such as buffering agents, dispersing agents and/or conductivity agents. Suitable buffering agents include boric acid which may be employed, for example, in an amount of from about 0.25 to about 45 g/l. Suitable dispersing agents that can be employed include, for example, alkyl benzene sulfonates, alkyl naphthalene sulfonates, lignin sulfonate, and mixtures thereof in amount up to about 12 g/l with amounts of about 10 mg/l to about 3 g/l being typical. The conductivity agents comprise bath soluble and compatible salts which impart increased electrical conductivity to the electrolyte and typically comprise alkali metal and ammonium chloride salts employed in conventional amounts with the concentration varying depending upon the concentration and types of other bath constituents to attain the desired conductivity.

In accordance with the method of the present invention, a bright, smooth, adherent zinc-alloy electroplate is obtained on a substrate by the steps of electrodepositing the zinc-alloy from an aqueous electroplating solution as described above. The electroplating step can be carried out by employing any one of a variety of well-known electroplating techniques including barrel-plating, rack-plating, continuous-plating and the like. The electroplating solution can be employed at temperatures ranging from about 60° to about 120° F. with temperatures of from about 75° to about 95° F. being preferred. The electroplating operation can be carried out over a broad range of average cathode current densities ranging from about 0.5 ASF to about 80 ASF. While the process of the present invention is particularly adapted for electroplating ferrous substrates such as iron and steel, it is also contemplated that other substrates can be electroplated such as brass, copper or conductive plastics.

The zinc-alloy electrodeposit can be a zinc-cobalt alloy, a zinc-nickel alloy, or a zinc-cobalt-nickel alloy. While the cobalt and nickel can be employed in any ratio, it is contemplated that the total amount of alloy metal will be present in the electrodeposit in an amount of from about 0.01 up to about 15 percent of the zinc alloy deposit. Preferably, for zinc-cobalt alloys, the cobalt is present in an amount of from about 0.1 to about 5 percent and for zinc-nickel alloys, the nickel is present within a range of about 0.25 to about 9 percent to minimize cost and yet to provide good appearance and performance even on complex-shaped parts.

In order to further illustrate the zinc-alloy plating bath of the present invention and its method of use, the following examples are provided. It will be understood, however, that these examples are provided for illustrative purposes and are not intended to be restrictive of the present invention as herein described and claimed in the attached claims.

EXAMPLE 1

An aqueous acidic electrolyte is prepared having the following composition:

| | |
|---|---|
| $ZnCl_2$ | 73 g/l |
| $CoCl_2$—$6H_2O$ | 32 g/l |
| NaCl | 125 g/l |
| $H_3BO_3$ | 30 g/l |
| pH | 5.4 |
| 2,4,7,9-tetramethyl-5-decyne-4,7-diol 30 mols ethoxylated* | 4.5 g/l |
| 4-Phenyl-3-buten-2-One | 60 mg/l |
| Butylnicotinate dimethyl sulfate quaternary | 30 mg/l |
| 4-phenyl-4-sulfobutan-2-one sodium salt | 50 mg/l |
| Sodium Benzoate | 2 g/l |

*Surfynol 485 - Air Products

A plating test was run on a "J-bent" cathode with air agitation at an average cathode current density of 40 ASF and a bath temperature of 26° C. (78° F.). After 15 minutes, the resulting deposit is fully bright and ductile over the entire cathode. The deposit is analyzed and found to contain 0.5 percent cobalt in the current density region of about 30 ASF. The deposit has good corrosion resistance.

EXAMPLE 2

The plating test of Example 1 is repeated except that a flat cathode test panel is plated at an average cathode current density of 5 ASF with no agitation. The resulting deposit on the test panel is bright and ductile and has good corrosion resistance. The electrodeposit is analyzed and found to contain 0.9 percent cobalt.

EXAMPLE 3

The plating test of Example 1 is repeated except that the solution is electrolyzed in a barrel at an average cathode current density of 10 ASF and the substrate comprises a plurality of steel screws. The resulting electrodeposit is a bright alloy deposit which has good corrosion resistance. The electrodeposit has 1.3 percent cobalt.

EXAMPLE 4

A aqueous acidic electrolyte is prepared having the following composition:

| | |
|---|---|
| zinc chloride | 70 g/l |
| $NiCl_2$—$6H_2O$ | 48 g/l |
| NaCl | 120 g/l |
| boric acid | 30 g/l |
| sodium benzoate | 2.6 g/l |
| Surfynol 485 | 4.8 g/l |
| butyl nicotinate diethyl sulfate quaternary | 10.0 mg/l |
| 4-phenyl-4-sulfonato-2-butanone | 36 mg/l |
| benzylidene acetone | 48 mg/l |

-continued

| | |
|---|---|
| isopropyl naphthalene sulfonate | 0.1 g/l |

The bath has a pH of 5.0 and a temperature of 72° F. Zinc anodes and air agitation are employed. Steel parts are subjected to electroplating in the bath at an average cathode current density of 20 ASF. The nickel content in the electrodeposit obtained is 0.3 percent. The electrodeposit obtained on the parts is fully bright and has good corrosion resistance.

EXAMPLE 5

An aqueous acidic electrolyte is prepared having the following composition:

| | |
|---|---|
| $ZnCl_2$ | 90 g/l |
| $NiCl_2$—$6H_2O$ | 120 g/l |
| $NH_4Cl$ | 200 g/l |
| sodium benzoate | 4 g/l |
| Surfynol 485 | 4.0 g/l |
| polyoxyethylene (MW1000) | 0.5 g/l |
| butyl nicotinate p-methyl tosylate | 80 mg/l |
| 4-phenyl-4-sodium sulfonato-2-butanal | 30 mg/l |
| benzylidene acetone | 50 mg/l |
| mixed alkyl naphthalene sulfonates | 80 mg/l |

The bath has a pH of 5.3 and a temperature of 78° F. Zinc anodes and air agitation are employed. Steel parts are electroplated in the bath at an average cathode current density of 10 ASF. The nickel content in the electrodeposit obtained is 1.4 percent. The electrodeposit obtained on the parts is fully bright and has good corrosion resistance.

EXAMPLE 6

A plating solution is prepared according to the following composition:

| | |
|---|---|
| $ZnCl_2$ | 90 g/l |
| $NiCl_2$—$6H_2O$ | 120 g/l |
| $CoCl_2$—$6H_2O$ | 40 g/l |
| $NH_4Cl$ | 200 g/l |
| Na benzoate | 2 g/l |
| Surfynol 485 | 5.0 g/l |
| quinaldine dimethyl sulfate quaternary | 5 mg/l |
| 4-sulfo-4-phenyl butan-2-one sodium salt | 40 mg/l |
| furfural acetone | 38 mg/l |
| mixed alkyl benzene sulfonates | 0.11 g/l |

The bath has a pH of 5.0 and a temperature of 75° F. Zinc anodes and air agitation are employed. A steel test panel is subjected to electroplating in the bath at an average cathode current density of 10 ASF. The nickel content in the electrodeposit obtained is 1.8 percent and the cobalt content is 1.5 percent. The electrodeposit obtained on the panel is fully bright and has good corrosion resistance.

EXAMPLE 7

An aqueous acidic electrolyte is prepared having the following composition:

| | |
|---|---|
| $ZnCl_2$ | 35 g/l |
| $CoCl_2$—$6H_2O$ | 40 g/l |
| $NiCl_2$—$6H_2O$ | 20 g/l |
| boric acid | 30 g/l |
| sodium benzoate | 4 g/l |
| sodium chloride | 120 g/l |

-continued

| | |
|---|---|
| Surfynol 485 | 3 g/l |
| Polyoxyethylene (MW1500) | 1 g/l |
| isopropyl nicotinate dimethyl sulfate quaternary | 8 mg/l |
| 3-sodium sulfonato propanal | 36 mg/l |
| benzylidene acetone | 52 mg/l |
| ethylnaphthalene sulfonate | 0.6 g/l |

The bath has a pH of 4.9 and a temperature of 76° F. Zinc anodes are employed. Parts are subjected to electroplating in the bath at an average cathode current density of 10 ASF with barrel rotation. The cobalt content in the electrodeposit obtained is 0.7 percent, and the nickel content is 0.6 percent. The electrodeposit obtained on the panel is fully bright and has good corrosion resistance.

EXAMPLE 8

A plating solution is prepared according to the following composition:

| | |
|---|---|
| $ZnCl_2$ | 40 g/l |
| $CoCl_2$—$6H_2O$ | 40 g/l |
| NaCl | 120 g/l |
| boric acid | 30 g/l |
| sodium benzoate | 2.2 g/l |
| Surfynol 485 | 5 g/l |
| propoxyethoxy block polymer | 0.2 g/l |
| 4-phenyl 4-sulfonato-2-butenone | 5 mg/l |
| lignin sulfonate | 0.05 g/l |
| benzylidene acetone | 60 g/l |

The bath has a pH of 4.7 and a temperature of 74° F. Zinc anodes and air agitation are employed. A steel test panel is subjected to electroplating in the bath at an average cathode current density of 12 ASF. The cobalt content in the electrodeposit is 0.6% and the electrodeposit obtained on the panel is lustrous.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic electrolyte for electrodepositing a zinc alloy on a substrate comprising:

(a) zinc ions present in an amount sufficient to electrodeposit zinc, (b) at least one additional metal ion selected from the group consisting of nickel, cobalt and mixtures thereof present in an amount sufficient to electrodeposit an alloy of zinc-nickel, zinc-cobalt and zinc-nickel-cobalt, (c) a brightening amount of a primary brightener, (d) a carrier brightener present in an amount effective to refine the grain of the zinc alloy electrodeposit, (e) an auxiliary brightener present in an amount effective to impart supplemental brightness to the zinc alloy electrodeposit, (f) a ductilizer present in an amount effective to impart ductility to the zinc alloy electrodeposit comprising a compound as well as the bath soluble and compatible salts thereof corresponding to the structural formula:

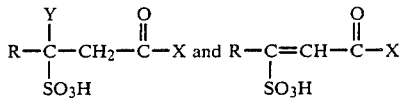

wherein:

R is H or $C_6$–$C_{10}$ aryl, or $C_6$–$C_{20}$ alkyl aryl in which the alkyl group is $C_1$–$C_4$; or $C_1$–$C_{22}$ alkyl, or $C_2$–$C_{10}$ heterocyclic nitrogen compounds having at least one tertiary or quaternary ring containing nitrogen; as well as the mono, di or tri substituted derivatives thereof including —OH, —$SO_3H$ or —COOH; the Group I and II metals and $NH_4$ salts thereof; and the aldehyde, ketone and ether derivatives thereof; X is R or —OR′ or —$NR_2$′ in which R′ is H or a $C_1$–$C_4$ aliphatic radical; and Y is H or $SO_3H$;

as well as the compatible water soluble salts thereof.

2. The electrolyte as defined in claim 1 in which said ductilizer is present in an amount of about 0.001 to about 10 g/l.

3. The electrolyte as defined in claim 1 in which said ductilizer is present in an amount of about 0.01 to about 5 g/l.

4. The electrolyte as defined in claim 1 further including hydrogen ions present in an amount to provide a pH of about 3 to about 6.9.

5. The electrolyte as defined in claim 1 further including hydrogen ions present in an amount to provide a pH of about 4 to about 6.

6. The electrolyte as defined in claim 1 in which said zinc ions are present in an amount of at least about 10 g/l up to solubility and said at least one additional metal ion is present in an amount of about 0.5 to about 60 g/l.

7. The electrolyte as defined in claim 1 in which said at least one additional metal ion is present in an amount of about 5 to about 25 g/l.

8. The electrolyte as defined in claim 1 in which said primary brightener is present in an amount of about 0.001 to about 10 g/l, said carrier brightener is present in an amount of about 0.5 to about 10 g/l and said auxiliary brightener is present in an amount of about 0.6 to about 10 g/l.

9. The electrolyte as defined in claim 1 in which said primary brightener is present in an amount of about 0.1 to about 5 g/l, said carrier brightener is present in an amount of about 2 to about 6 g/l and said auxiliary brightener is present in an amount of about 0.2 to about 5 g/l.

10. The electrolyte as defined in claim 1 further including a buffering agent present in an amount sufficient to stabilize the pH of said electrolyte.

11. The electrolyte as defined in claim 1 further including a dispersing agent.

12. The electrolyte as defined in claim 1 further including bath soluble and compatible conductivity salts present in an amount sufficient to enhance the electrical conductivity of the electrolyte.

13. The electrolyte as defined in claim 1 in which said at least one additional metal ion is present in an amount to produce a zinc alloy electrodeposit containing from about 0.01 to about 15 percent by weight of nickel and/or cobalt in the alloy electrodeposit.

14. The electrolyte as defined in claim 1 in which said one additional metal ion comprises cobalt present in said electrolyte in an amount to provide a zinc-cobalt alloy electrodeposit containing about 0.1 to about 5 percent by weight cobalt.

15. The electrolyte as defined in claim 1 in which said at least one additional metal ion comprises nickel present in the electrolyte in an amount to produce a zinc-nickel alloy electrodeposit containing about 0.25 to about 9 percent nickel in the alloy.

16. The electrolyte as defined in claim 1 in which said primary brightener comprises an alkyl nicotinate quaternary compound and said carrier brightener comprises an alkoxylated acetylenic compound.

17. A process for electrodepositing a zinc alloy on a conductive substrate which comprises the steps of contacting a substrate with the aqueous acidic electrolyte as defined in claim 1 and electrodepositing a zinc alloy on the substrate to a desired thickness.

18. The process as defined in claim 17 including the further step of controlling the temperature of the electrolyte within a range of about 60° to about 120° F.

19. The process as defined in claim 17 including the further step of controlling the pH of said electrolyte within a range of about 3 to about 6.9.

20. The process as defined in claim 17 including the further step of controlling the average cathode current density during the step of electrodepositing the zinc alloy on the substrate within a range of about 0.5 to about 80 ASF.

* * * * *